US008200104B2

(12) United States Patent
Ito et al.

(10) Patent No.: US 8,200,104 B2
(45) Date of Patent: Jun. 12, 2012

(54) IMAGE FORMING APPARATUS INCLUDING IMAGE BEARING MEMBER SURFACE ABRASSION CONTROL FEATURE

(75) Inventors: Shingo Ito, Tokyo (JP); Tetsuya Atsumi, Tokyo (JP); Masatsugu Toyonori, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 294 days.

(21) Appl. No.: 12/713,420

(22) Filed: Feb. 26, 2010

(65) Prior Publication Data

US 2010/0226673 A1 Sep. 9, 2010

(30) Foreign Application Priority Data

Mar. 9, 2009 (JP) ..... 2009-055214
Feb. 9, 2010 (JP) ..... 2010-026575

(51) Int. Cl.
*G03G 15/00* (2006.01)
*G03G 15/08* (2006.01)

(52) U.S. Cl. ..... 399/26; 399/259

(58) Field of Classification Search ..... 399/26, 399/259, 274, 53, 258, 260, 282, 58
See application file for complete search history.

(56) References Cited

U.S. PATENT DOCUMENTS 7,103,303 B2 9/2006 Suzuki et al.
2004/0223776 A1* 11/2004 Ishida ..... 399/49
2007/0140714 A1* 6/2007 Kurita et al. ..... 399/44

FOREIGN PATENT DOCUMENTS

JP 11-149194 A 6/1999
JP 2001-42600 A 2/2001

* cited by examiner

*Primary Examiner* — David Gray
*Assistant Examiner* — Billy J Lactaoen
(74) *Attorney, Agent, or Firm* — Fitzpatrick, Cella, Harper & Scinto

(57) ABSTRACT

An image forming apparatus includes an image bearing member for bearing an electrostatic latent image; a charger for electrically charging the image bearing member by contact of electroconductive magnetic particles carried on a magnetic particle carrying member with the image bearing member; a developing device for developing the electrostatic latent image into a toner image by supplying toner to the electrostatic latent image; a layer thickness detecting device for detecting a thickness of a surface layer of the image bearing member; a supplying device for supplying the magnetic particles to the magnetic particle carrying member with predetermined timing; and a control device for controlling a supply amount of the magnetic particles so that the supply amount of the magnetic particles supplied by the supplying device increases with an increase of an amount of change in thickness, in terms of an absolute value, of the surface layer obtained from a detection result of the layer thickness detecting device.

6 Claims, 6 Drawing Sheets

(a)

| |
|---|
| SURFACE LAYER |
| UPPER BLOCKING LAYER |
| PHOTOSENSITIVE LAYER |
| LOWER BLOCKING LAYER |
| CONDUCTIVE SUPPORT |

(b)

IMAGE FORMING APPARATUS INCLUDING IMAGE BEARING MEMBER SURFACE ABRASSION CONTROL FEATURE

FIELD OF THE INVENTION AND RELATED ART

The present invention relates to an image forming apparatus, such as a copying machine or a printer, employing an electrophotographic method, an electrostatic recording method, or the like.

In the image forming apparatus employing the electrophotographic method, the electrostatic recording method, or the like, a charger for electrically charging a surface of a cylindrical image bearing member by imparting positive or negative electric charges to the image bearing member is provided. As a charging method using the charger, there have been principally known three types of charging methods including a corona charging method, a roller charging method, and an injection charging method.

Of these charging methods, the injection charging method charges the surface of the image bearing member by injecting electric charges from an electroconductive member to the surface of the image bearing member and as the electroconductive member, a magnetic brush is used in many cases. Different from other methods, the injection charging method is of the type wherein an electric discharge phenomenon is not utilized, thus having the advantages such that an electric discharge product is not formed to avoid deficiencies such as off-flavor, image defect, and the like caused by the electric discharge product. Further, even when toner or the like is included in the charger in some degree, a possibility that the inclusion leads to charging failure is low, i.e., the injection charging method also has the advantages that the injection charging method is resistive to contamination.

A magnetic brush injection charging method (hereinafter referred to as the injection charging method is accompanied with, as one of problems thereof, such a problem that a surface layer of the image bearing member is abraded by the magnetic brush since the magnetic brush rotates always in contact with the image bearing member during image formation. The image bearing member surface layer has the function of holding electric charges for forming a latent image, so that when the image bearing member surface layer is abraded, the electric charge holding function for the image bearing member is lowered correspondingly. That is, a lifetime of the image bearing member can be said that it depends on an abrasion speed of the image bearing member surface layer (hereinafter referred to as a surface layer abrasion speed), thus being shortened with an increasing surface layer abrasion speed and the lifetime of the image forming apparatus including the image bearing member is also decreased.

Further, the surface layer abrasion speed has been known that it depends on a state of magnetic particles magnetic particles constituting the magnetic brush. That is, the surface layer abrasion speed is not always constant but is changed correspondingly when the state of the magnetic particles is changed. For example, even when the surface layer abrasion speed is small in an initial state, the state of the magnetic particles is changed with an increasing number of print sheets to increase the surface layer abrasion speed in some cases.

More specifically, when external additives for the toner such as silica and the like is included in the magnetic brush and is deposited on the surfaces of the magnetic particles, the external additives function as an abrading material, so that the surface layer abrasion speed is increased in some cases. Further, the surface layer abrasion speed is also changed by abrasion (wearing) of the magnetic particles in the magnetic brush, with the increasing number of print sheets, thereby to deteriorate the surfaces of the magnetic particles.

Thus, the surface layer abrasion speed is not always constant, so that it is difficult to estimate the lifetime of the image bearing member. That is, even when the lifetime of the image bearing member can be estimated on the basis of a certain value of the surface layer abrasion speed, e.g., in the case where the surface layer abrasion speed is increased during the image formation, the image bearing member cannot live out its lifetime estimated in advance.

In view of these problems, Japanese Laid-Open Patent Application (JP-A) 2001-42600 discloses a method in which magnetic particles which have been changed in state (condition) are replaced with fresh (new) magnetic particles. According to this method, the magnetic particles in a substantially same state can be continuously used, so that the method is effective in permitting the image bearing member and the image forming apparatus to live out their lifetimes estimated in advance. However, when an exchange frequency of the magnetic particles is high, a cost is increased correspondingly, so that the exchange frequency of a supplying container is required to be increased or a larger supplying container is required to be provided. As a result, the method is accompanied with a problem of a load on a user or an occurrence of a trouble in terms of a space.

JP-A Hei 11-149194 discloses a method in which the exchange frequency of the magnetic particles is controlled on the basis of pressure information such that a pressure of the magnetic particles exerted on a regulating blade is correlated with a charging property and the surface layer abrasion of the image bearing member. Certainly, there are some cases where the pressure exerted on the regulating blade and the surface layer abrasion speed show a correlation. However, also in the case where the pressure is low, e.g., in the case where the magnetic particles are contaminated with external additives liberated from the toner, the surface layer abrasion speed is increased. Therefore, the surface layer abrasion is not always controlled on the basis of the pressure information.

Further, U.S. Pat. No. 7,103,303 discloses a method in which an electric resistance of the magnetic particles is measured and when the electric resistance exceeds a certain reference value, fresh magnetic particles are supplied. However, the electric resistance is strongly correlated with the charging property but is not so correlated with the surface layer abrasion speed, so that it is difficult to control the surface layer abrasion by this method.

SUMMARY OF THE INVENTION

A principal object of the present invention is to provide an image forming apparatus, including a charger employing a magnetic brush charging method, capable of controlling surface layer abrasion of an image bearing member with a less exchange frequency of magnetic particles to live out its lifetime estimated in advance.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 4(A) and 4(*b*) are schematic structural views of a charger in Second Embodiment.

DETAILED DESCRIPTION OF THE DRAWINGS

Hereinbelow, with reference to the drawings, embodiments of the present invention will be described in detail. However, dimensions, materials, shapes, and relative arrangements of constituent elements in the present invention are not limited to those described in the following embodiments unless otherwise specified.

First Embodiment

Figure 1:
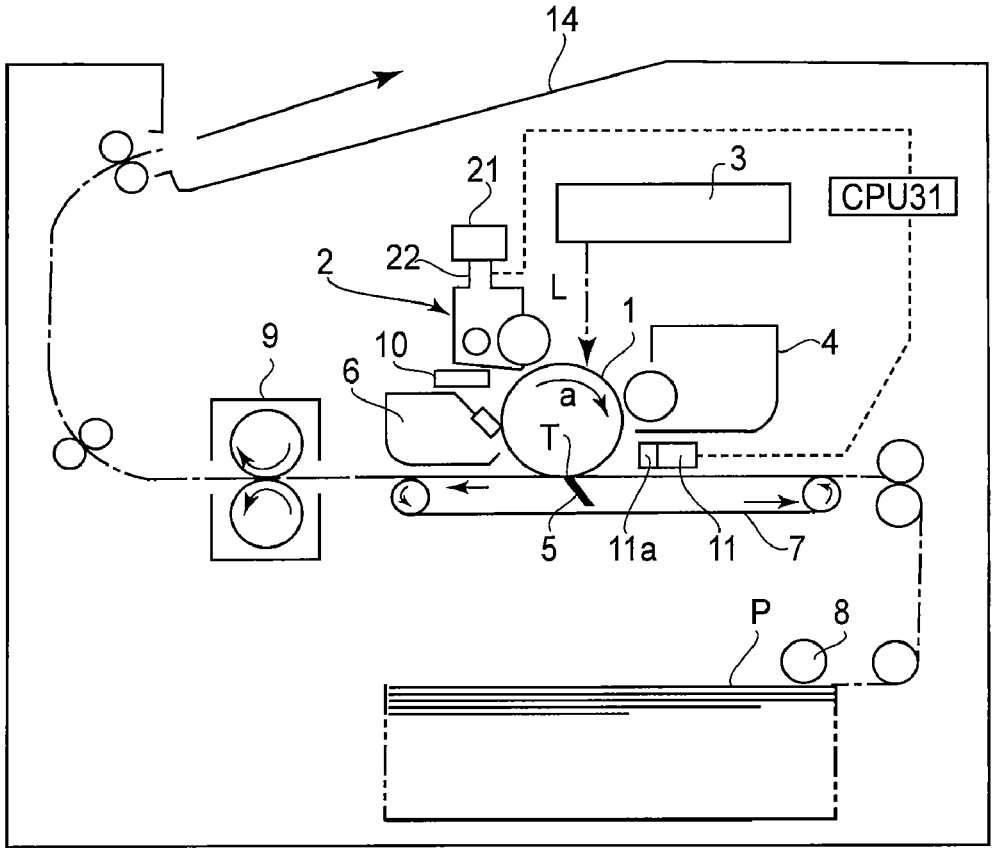
FIG. 1 is a schematic structural view of an image forming apparatus according to First Embodiment.
Figure 2:
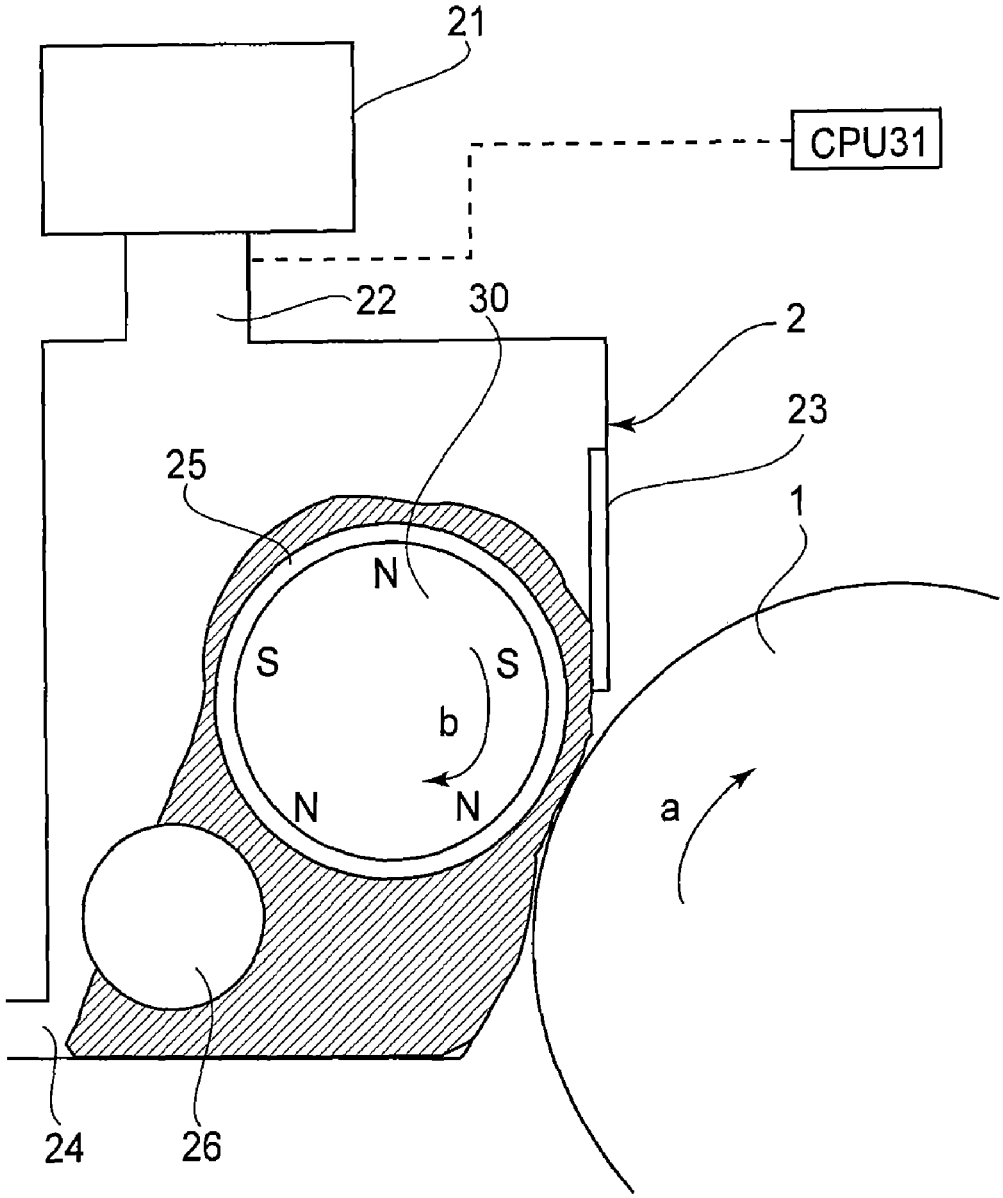
FIG. 2 is a schematic structural view of a charger in First Embodiment.
Figure 3:
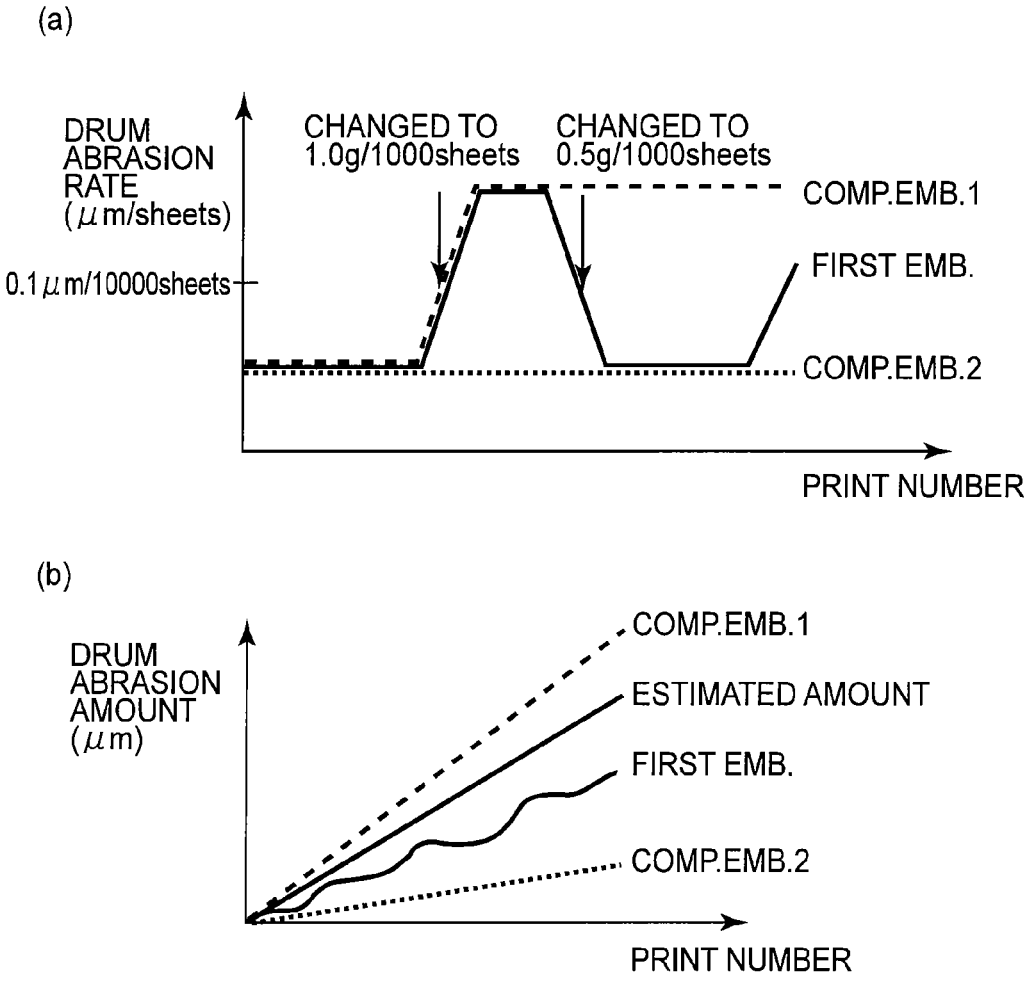
FIGS. 3(*a*) and 3(*b*) are graphs relating to supplying rate control of magnetic particles in Embodiment 1.

With reference to FIGS. 1 to 3, an image forming apparatus according to First Embodiment of the present invention will be described.

(General Structure of Image Bearing Member)

A photosensitive drum 1 (cylindrical image bearing member) is a negatively chargeable organic photosensitive member and includes an aluminum drum support having a diameter of 84 mm and first to fifth layers described below. The photosensitive drum 1 is rotationally driven in a direction indicated by an arrow a at a predetermined process speed.

The first layer as a lowest layer on the drum support of the photosensitive drum 1 is an undercoat layer which is a 20 μm-thick electroconductive provided for fattening the surface of the drum support. The second layer is a positive electric charge injection preventing layer which is a 1 μm-thick medium resistance layer formed of nylon resin ("Amilan", mfd. by Toray Industries, Inc.) and methoxymethylated nylon and is adjusted to have a resistance of about $10^6$ ohm·cm. This layer has the function of preventing negative electric charges on the surface of the photosensitive drum 1 from being canceled by positive electric charges injected from the drum support. The third layer is a charge generating layer which is an about 0.3 μm-thick layer in which a disazo pigment is dispersed in a resin material and generates a pair of positive and negative electric charges by being subjected to light exposure. The fourth layer is a charge transporting layer is a p-type semiconductor layer in which hydrazone is dispersed in polycarbonate resin. Therefore, the negative electric charges provided to the surface of the photosensitive drum 1 cannot move through this layer (fourth layer) and can transport only the positive electric charges, generated in the third layer (charge generating layer), to the surface of the photosensitive drum 1. The fifth layer as a surface layer is a charge injection layer which is a coating layer of a material such that $SnO_2$ ultrafine particles are dispersed as electroconductive particles in a binder of an insulative resin material. Specifically, the coating liquid for the coating layer is prepared by dispersing 70 wt. % of transparent $SnO_2$ fine particles, doped with antimony to lower the resistance (to impart electroconductivity), in the insulating resin material. The thus-prepared coating liquid is coated in a thickness of about 3 μm to prepare the charge injection layer by an appropriate coating method such as a dipping coating method, a spray coating method, a roll coating method, a beam coating method, or the like.

(General Structure of Charger)

Next, a schematic structure of the charger in this embodiment will be described. FIG. 2 shows the schematic structure of a magnetic brush injection charger 2 (hereinafter referred to as a charger 2). The charger 2 includes a magnet roller 30 fixed in a charging container and a sleeve 25 which is externally and rotatably engaged with the magnet roller 30 and is formed of a non-magnetic material (e.g., stainless steel) to have an outer diameter of 16 mm. On an outer peripheral surface of this sleeve 25, electroconductive magnetic particles are carried in a brush-like shape by a magnetic force of the magnet roller 30, so that the carried magnetic particles contact the surface of the photosensitive drum 1 to inject the electric charges to the surface of the photosensitive drum 1. That is, the sleeve 25 is provided as a magnetic particle carrying member. Further, the charger 2 includes a regulating blade 23, formed of the non-magnetic material (e.g., stainless steel), for coating the magnetic particles on the surface 25 in a uniform thickness.

The sleeve 25 rotates in a counter direction with respect to the photosensitive drum 1 and specifically, in this embodiment, rotates in a direction indicated by an arrow b at the process speed of 360 mm/sec, while the photosensitive drum 1 rotates at the process speed of 300 mm/sec. Further, a width of a contact nip created between the magnetic particles and the photosensitive drum 1 is adjusted at about 6 mm. Further, to the sleeve 25, a charging bias (in the form of a DC voltage biased with an AC voltage) is applied from a charging bias power source (not shown). By applying the charging bias to the sleeve 25, the electric charges are injected from the magnetic particles to the surface layer of the photosensitive drum 1, so that the photosensitive drum 1 is electrically charged to a potential close to the charging bias. The charging bias in this embodiment includes the DV voltage of −650 V and the AC voltage of 500 V in peak-to-peak voltage and 1000 Hz in frequency.

Above the charger 2, a magnetic particle accommodating portion 21 in which fresh magnetic particles which have not been contaminated with and abraded by the external additives are accommodated, and a magnetic particle supplying device 22 for supplying the magnetic particles in the magnetic particle accommodating portion 21 are provided. Further, the magnetic particle supplying device 22 is connected to a CPU 31 (control device) provided to a main assembly of the image forming apparatus, and a supply amount of the magnetic particles is controlled by the CPU 31. The magnetic particles in the magnetic particle accommodating portion 21 are supplied to a magnetic particle storing portion (in the neighborhood of a lower portion of the magnetic particle supplying device 22) upstream of the regulating blade 23 with respect to the rotational direction (the arrow b direction) of the sleeve 25, by the magnetic particle supplying device 22. The magnetic particles are conveyed in the arrow b direction by the rotation of the sleeve 25. In this embodiment, in the magnetic particle accommodating portion 21, 500 g of the magnetic particles are accommodated in an initial state.

Further, the charger 2 includes a stirring member 26 and is provided with a magnetic particle discharge opening 24. The stirring member 26 stirs the magnetic particles in the charger 2. Further, by providing the magnetic particle discharge opening 24, when the magnetic particles are supplied and the amount thereof is equal to or larger than a certain amount in the charger 2, the magnetic particles flows out of the charger 2 through the magnetic particle discharge opening 24. As a result, exchange of the magnetic particles is easily performed.

(Magnetic Particles)

In this embodiment, as the electroconductive magnetic particles, magnetic particles prepared by subjecting ferrite particle surfaces to a redox treatment to adjust the resistance and then by coating the ferrite particle surfaces with 1.0 wt. % of a coating material in which carbon black was dispersed in a silicone-based resin material to adjust the resistance was used. The magnetic particles have an average particle size of 25 μm, saturation magnetization of 200 emu/cm$^3$, and a resistance of $5\times10^6$ ohm·cm. Incidentally, the measurement of the resistance of the magnetic particles was carried out by applying a load of 6.6 kg/cm$^2$ and a voltage of 100 V to both end portions of a metal cell after 2 g of the magnetic particles were placed in the metal cell having a bottom surface area of 227 mm$^2$.

(Supply Frequency of Magnetic Particles)

With respect to the supply frequency of the magnetic particles, when the supplying ratio of the magnetic particles is, e.g., 1 g per 1,000 sheets, the supply frequency of 0.1 g per 100 sheets or the supply frequency of 1 g per 1,000 sheets can be considered.

For example, when a method in which the supply frequency such that the magnetic particles are supplied every 10 sheets is employed, the supply amount per once is 0.01 g, so that the supply amount is required to be controlled with high accuracy. On the other hand, when the supply frequency is decreased and a method in which the magnetic particles are supplied, e.g., every 10,000 sheets is employed, deterioration of the magnetic particles is considerably accelerated during the image formation, so that the deteriorated magnetic particles and fresh magnetic particles are co-present in the magnetic brush when the fresh magnetic particles are supplied. Therefore, it is desirable that the supply frequency is to the extent such that the magnetic particles are supplied every printing on 100 sheets to 1,000 sheets.

(Image Forming Process)

With reference to FIG. 1, the image forming process in this embodiment will be described. FIG. 1 shows the schematic structure of the image forming apparatus according to this embodiment.

When the image forming process is started, first, the surface of the photosensitive drum 1 is uniformly charged to −650 V by the charger 2. Then, laser light L modulated by an image signal is emitted from an exposure device 3 to effect scanning exposure, so that an electrostatic latent image is formed on the photosensitive drum 1. Thereafter, toner is supplied by a developing device 4, so that the electrostatic latent image is reversely developed to provide a toner image on the photosensitive drum 1.

In this embodiment, a two component developing method using negatively chargeable toner and a magnetic carrier is employed. The toner is prepared by dispersing a pigment or wax in a resin material having an average diameter of 6 μm through a pulverization method. To the toner, titanium oxide particles having an average diameter of 20 nm or silica particles having an average diameter of 100 nm are externally added in an amount of about 1 wt. % per the toner. As the magnetic carrier, magnetic particles having saturation magnetization of 205 emu/cm$^3$ and an average particle size of 35 μm were used.

When the toner image on the photosensitive drum 1 reaches a transfer nip between the photosensitive drum 1 and a transfer belt 7, a sheet material P (member to be transferred) in a sheet feeding cassette is fed by a sheet feeding roller and then is conveyed by registration rollers while being times to the toner image. Then, the positive electric charges opposite in polarity to the charge polarity of the toner are provided to a back surface of the sheet material P by a transfer blade 5 supplied with a transfer bias. The sheet material P onto which the toner image is transferred is conveyed to a fixing device 9 by the transfer belt 7 and is fixed as a permanently fixed image on the surface of the sheet material P under application of heat and pressure by the fixing device 9, so that the sheet material P is discharged on a sheet discharge portion 14.

Incidentally, on the surface of the photosensitive drum 1 after the toner image transfer, untransferred toner remains. The untransferred toner is removed and collected by a cleaning blade of a cleaning device 6. When, the toner image transfer is completed, the photosensitive drum 1 is charge-removed to 0 V by the light exposure from an LED array 10 and then is electrically charged again by the charger 2.

However, most of the untransferred toner or the external additives which are deposited on the surface of the photosensitive drum 1 are removed by the cleaning blade but the external additives passes through the cleaning blade to some extent and enters the charger 2. When the external additives are accumulated in the magnetic brush, the external additives function as abrading particles to abrade the surface layer of the photosensitive drum 1 in a larger amount than that in a normal state. A degree of the inclusion of the external additives in the magnetic brush varies depending on various factors such as a transfer residual amount, an image print ratio, an abrasion state of the cleaning blade, and a state in which the toner is left in the neighborhood of a cleaning blade nip, and the like. Therefore, a degree of abrasion of the surface layer of the photosensitive drum 1 (surface layer abrasion speed) is also changed depending on these factors.

In this embodiment, with respect to the rotational direction of the photosensitive drum 1, between the developing device 4 and the transfer nip (transfer position), a detachably mountable layer thickness measuring device 11 (layer thickness detecting device) employing the eddy current method is provided. The position of the layer thickness measuring device 11 is not limited to the above position but may preferably be a position in which the surface layer of the photosensitive drum 1 is less liable to be contaminated with the toner or the like and is less liable to interfere with other members. Hereinafter, a method in which the layer thickness of the photosensitive drum 1 surface layer is measured by the layer thickness measuring device 11 and the CPU 31 (control device) controls the supply rate (supply amount) of the magnetic particles on the basis of an amount of change in layer thickness, in terms of an absolute value, calculated from a result of the measurement (detection result).

(Layer Thickness Measuring Device)

In the eddy current method employed by the layer thickness measuring device 11 in this embodiment, a total layer thickness of the photosensitive drum 1 is detected but the change in total layer thickness of the photosensitive drum 1 itself corresponds to the change in surface layer thickness of the photosensitive drum 1, so that the change in surface layer thickness of the photosensitive drum 1 can be detected.

Figure 6:
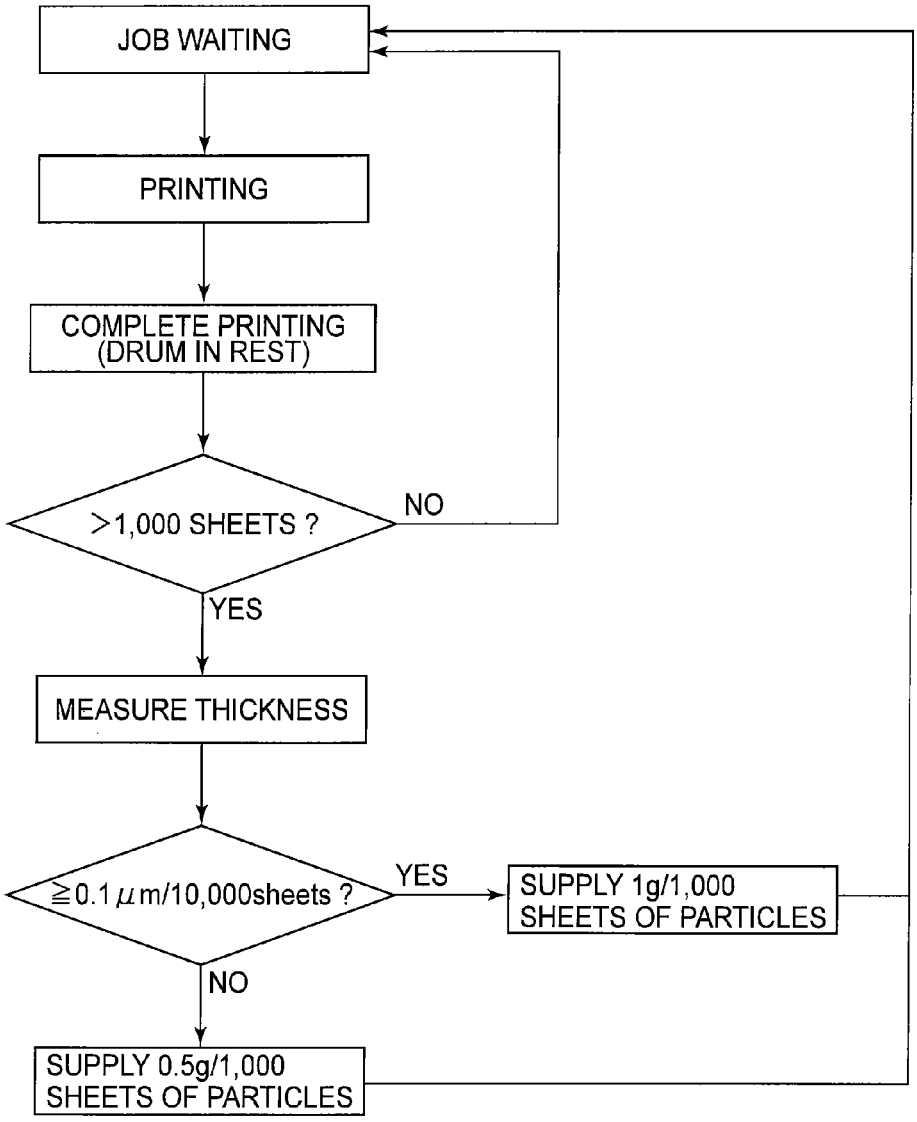
FIG. 6 is a flowchart of layer thickness detection and magnetic particle supplying rate control.

FIG. 6 shows a specific flow of the layer thickness detection and control of the magnetic particle supplying rate. The photosensitive drum 1 and the layer thickness measuring device 11 are ordinarily separated from each other but the layer thickness measuring device 11 contacts the photosensitive drum 1 every printing on 1,000 sheets when the photosensitive drum 1 is in rest thus detecting the layer thickness. At this time, in order to eliminate a measurement error, the layer thickness may also be detected at several points along the circumferential direction of the photosensitive drum 1.

Detected values of the layer thickness are stored in a memory and on the basis of the measurement result immediately before the storing in the memory, when a change in layer thickness of not less than 0.1 μm per 1,000 sheets is detected, the measuring device supplying rate is set at 1 g per 1,000 sheets. Further, when the layer thickness change amount is less than 0.1 μm per 10,000 sheets, the CPU 31 controls the supply amount of the magnetic particles from the magnetic particle supplying device 22 so as to be 0.5 g per 1,000 sheets.

Thus, in this embodiment, the layer thickness change amount of the surface layer of the photosensitive drum 1 is obtained by the layer thickness measuring device 11 every time (predetermined timing) when the number of sheets subjected to image formation reaches a predetermined number (1,000 sheets in this embodiment) and on the basis of the obtained values, the CPU 31 controls the magnetic particle supply amount.

Further, in this embodiment, the supplying rate is controlled based on whether or not the layer thickness change amount is not less than 0.1 μm (reference value). That is, the layer thickness change amount of 0.1 μm is used as the reference value but the reference value in the present invention is not limited to 0.1 μm.

For comparison with this embodiment, two embodiments (Comparative Embodiments 1 and 2) in which the layer thickness measuring device 11 is not provided will be described. In the image forming apparatus in Comparative Embodiment 1, the magnetic particle supplying rate is kept constant at 0.5 g per 1,000 sheets. In the image forming apparatus in Comparative Embodiment 2, the magnetic particle supplying rate is kept constant at 1.0 g per 1,000 sheets. That is, both of the image forming apparatuses in Comparative Embodiments 1 and 2 do not employ the constitution in which the supply amount of the magnetic particles is controlled.

FIG. 3(*a*) is a graph showing a relationship between the print number and the surface layer abrasion speed (amount/sheets) of the photosensitive drum 1. A print ratio of an image subjected to printing is randomly changed in a range from 3% to 20% every 1,000 sheets. In Comparative Embodiment 1, the magnetic particle supply amount is low and thus when the print number is increased, contamination of the magnetic particles with the external additives or the like occurs from some point of time (when, e.g., an image having a high print ratio is continuously formed). Then, the external additives or the like causing the contamination of the magnetic particles function as abrading particles for the photosensitive drum surface layer, so that the surface layer abrasion speed is increased. Further, the surface layer abrasion speed is not recovered.

On the other hand, in the image forming apparatus in Comparative Embodiment 2, the magnetic particle supply amount is large and thus the contamination of the magnetic particles with the external additives is suppressed to a low level, so that a slope of the surface layer abrasion amount (surface layer abrasion speed) of the photosensitive drum 1 is also suppressed to a low level. In this embodiment, the magnetic particle supplying rate is increased when the surface layer abrasion speed is increased, so that the contamination of the magnetic particles with the external additives is eliminated and the surface layer abrasion speed is recovered. Then, when the surface layer abrasion speed is recovered, the magnetic particle supplying rate is returned to a normal supplying rate. As a result, the magnetic particles are not supplied more than necessary, so that cost reduction can be accomplished while recovering the surface layer abrasion speed.

FIG. 3(*b*) is a graph showing a relationship between the print number and the surface layer abrasion amount (μm) of the photosensitive drum 1 in First Embodiment and Comparative Embodiments 1 and 2. In FIG. 3(*b*), a thick line represents progression of an estimated abrasion amount in the case where the photosensitive drum just lines out the lifetime of the photosensitive drum and shows that the photosensitive drum cannot live out its lifetime when the surface layer abrasion amount progresses with values more than those in the thick line.

In Comparative Embodiment 1, the surface layer abrasion amount was increased in the course of the continuous image formation, so that the photosensitive drum was not able to live out its estimated lifetime. On the other hand, in First Embodiment, the abrasion amount is somewhat increased compared with that in Comparative Embodiment 2 but is enough to permit the photosensitive drum to live out the estimated photosensitive drum lifetime.

Further, in First Embodiment, the magnetic particles accommodated in the magnetic particle accommodating portion 21 were able to be retained until the print number reached 900,000 sheets. On the other hand, in Comparative Embodiment 2, the surface layer abrasion speed was able to be kept at a low level throughout but the magnetic particle supply amount set at a high level, so that the magnetic particles accommodated in advance in the magnetic particle accommodating portion 21 was used up when the print number reached 500,000 sheets. That is, the image forming apparatus in First Embodiment succeeds in living out the lifetime of the photosensitive drum 1 and prolonging exchange timing of the magnetic particle accommodating portion 21, thus being superior to those in Comparative Embodiments 1 and 2 in terms of cost and convenience of the user.

That is, according to First Embodiment, it is possible to provide the image forming apparatus, including the charger employing the magnetic brush injection charging method, capable of permitting the image bearing member to live out the preliminarily estimated lifetime by controlling the surface layer abrasion amount (speed) of the image bearing member with less exchange frequency of the magnetic particles.

Second Embodiment

Figure 4:
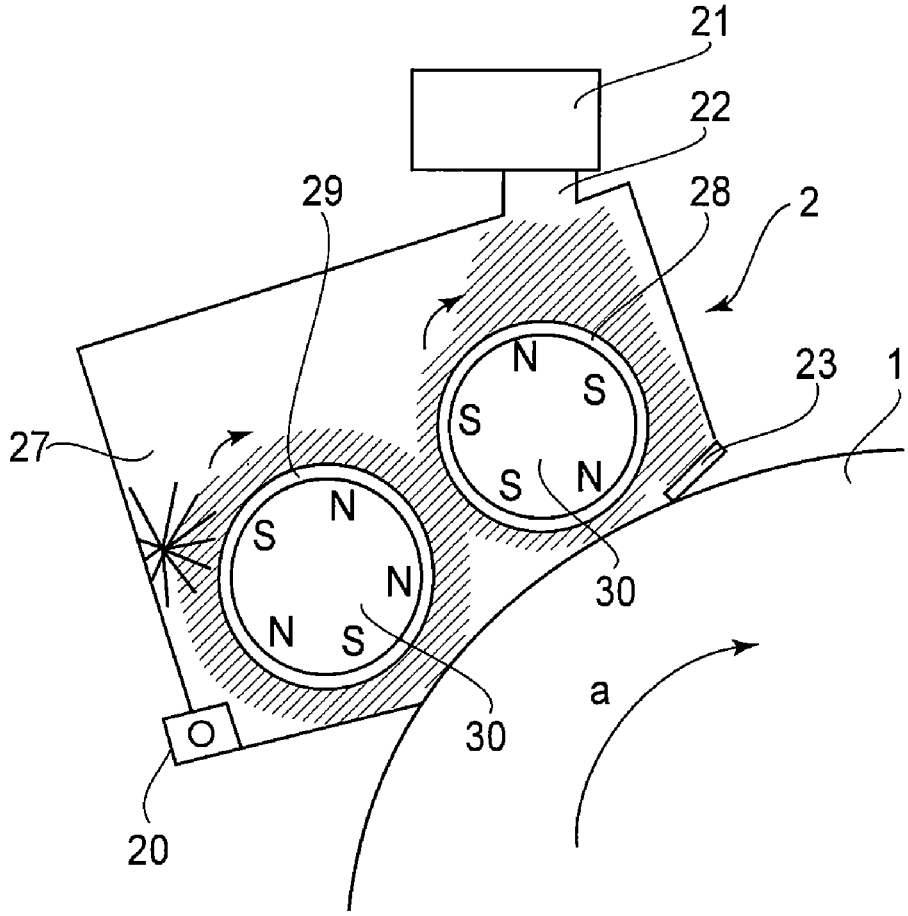
Figure 5:
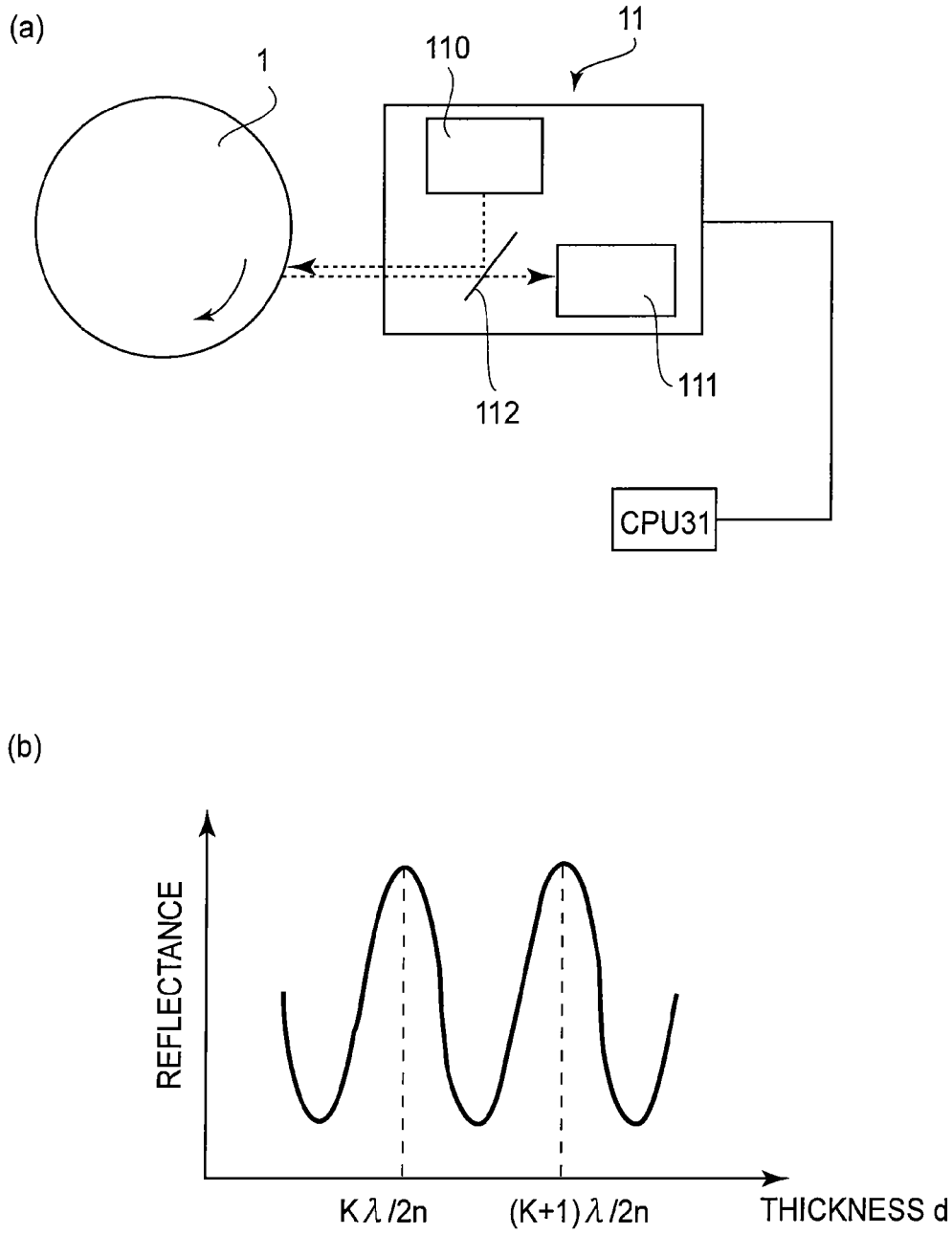
FIGS. 5(*a*) and 5(*b*) are schematic structural views showing a layer thickness measuring device and a measuring result in Second Embodiment.

With reference to FIGS. 4 and 5, the image forming apparatus in Second Embodiment will be described. In this embodiment, the type of the magnetic particles, the constitution of the image forming apparatus, and the like are the same as those in First Embodiment. Therefore, the same constitutions will be omitted from description and only a constitution different from that in First Embodiment will be described.

In this embodiment, the use, as the photosensitive drum 1, of an amorphous silicon type photosensitive member including a plurality of layers is a characteristic feature. A layer structure of the photosensitive drum 1 of the amorphous silicon type is shown in FIG. 4(*a*). The photosensitive drum 1 is constituted by an electroconductive support of A1 or the like, a lower charging injection blocking layer, a photosensitive layer, an upper charge injection layer, and a surface layer. All the layers are formed on a bare tube of A1 having a diameter of 84 mm by a film-forming method such as plasma CVD or the like.

The surface layer has a resistance of about $10^{13}$ ohm·cm so as to permit electric charge injection by the charger 2 and is formed so that the laser light (exposure light) during the latent image formation sufficiently passes through the surface layer. The layer thickness of the surface layer is about 1.2 μm. The upper charge injection blocking layer in a p-type semiconductor layer and has the function of preventing the negative electric charges injected through the surface layer from flowing into the electroconductive support. The photosensitive layer absorbs the light for the latent image formation and generates a pair of electron and hole. The generated hole passes through the upper charge injection blocking layer which is the p-type semiconductor layer and cancels the charged electron in the surface layer, thus having the function of forming the latent image. On the other hand, the generated electron passes through the lower charge injection blocking layer which is an n-type semiconductor layer to reach the electroconductive support. The lower charge injection blocking layer is configured to block diffusion of the hole from the electroconductive support to the surface layer.

FIG. 4(*b*) shows a schematic structure of the charger 2 in this embodiment. The charger 2 includes a rotatable first sleeve 29 and a rotatable second sleeve 28 provided downstream of the first sleeve 29 with respect to the rotational direction of the photosensitive drum 1. In each of the sleeves, a magnet 30 as a magnetic field generating member having a 5-pole constitution is provided. By magnetic confining force of these magnets 30, the magnetic particles are confined, so that a magnetic brush is formed on the surface of each sleeve.

Both of the first and second sleeves 29 and 28 are moved in the direction opposite from the rotational direction of the photosensitive drum 1 in the charging nip. The amount of the magnetic particles to be coated on each of the sleeves is regulated by the regulating blade 23 disposed downstream of the second sleeve 28 with respect to the rotational direction of the photosensitive drum 1.

The magnetic particles having passed between the regulating blade 23 and the second sleeve 28 are conveyed on the second sleeve 28 in the opposite direction to the rotational direction of the photosensitive drum 1, thus passing through the charging nip to be transferred to the first sleeve 29. Then, the magnetic particles passes through the charging nip of the first sleeve 29 and thereafter is transferred to the second sleeve 28, thus being mixed with the magnetic particles stagnated in the neighborhood of the regulating blade 23 to be circulated repeatedly in the charger 2.

The supply of the fresh magnetic particles from the magnetic particle accommodating portion 21 is performed by the magnetic particle supplying device 25, so that the fresh magnetic particles are supplied to the neighborhood of the regulating blade 23. The magnetic particle supplying rate is controlled by the CPU 31 similarly as in First Embodiment.

When the magnetic particles are supplied, at the same time, a magnetic particle collecting member 27 removes the magnetic particles carried on the first sleeve 29. The magnetic particle collecting member 27 is prepared by providing blades to a peripheral surface of a rod member which has a shaft with respect to the longitudinal direction of the sleeves and is rotationally driven about the shaft. The removed magnetic particles are conveyed to a magnetic particle collecting portion (not shown) by a conveying screw 20.

In this embodiment, by knowing the weight of the magnetic particles collected in the magnetic particle collecting portion, the amount of the magnetic particles supplied from the magnetic particle supplying device 22 and the amount of the collected magnetic particles are adjusted so as to be nearly equal to each other.

With reference to FIGS. 5(*a*) and 5(*b*), the layer thickness measuring device 11 in this embodiment will be described. The layer thickness measuring device 11 in this embodiment employs a measuring method different from that in First Embodiment.

The layer thickness measuring device 11 includes a light source 110 and a light-receiving element 111 and detects, by the light-receiving element 111, intensity of laser light which is emitted from the light source 110, reflected by a half mirror 112, incident on the surface layer of the photosensitive drum 1, and reflected by the surface layer of the photosensitive drum 1 (FIG. 5(*a*)). In this embodiment, the light source 110 for emitting light of 470 nm in wavelength and the light-receiving element having a sensitivity to the wavelength of the light are used.

The light detected by the light-receiving element 111 is superposed light of the light reflected by the surface of the surface layer of the photosensitive drum 1 and the light which has passed through the surface layer and is reflected by an interface between the upper charge injection blocking layer and the surface layer (an interface between two layers different in refractive index), so that these two lights cause interference.

FIG. 5(*b*) is a graph showing a relationship between the surface layer thickness of the photosensitive drum 1 and intensity of the light received by the light-receiving element 111 (reflectance). In FIG. 5(*b*), k is a positive integer, $\lambda$ is a wavelength, n is a refractive index of the surface layer (at the wavelength $\lambda$), and d is the thickness of the surface layer. It is understood from FIG. 5(*b*) that the light intensity detected by the light-receiving element 111, i.e., the reflectance is maximum when a relationship of: $k\lambda=2nd$ is satisfied. Further, it is also understood that the reflectance is minimum at a middle thickness value between two values of d satisfying the above relationship. That is, when the thickness of the surface layer of an unused photosensitive drum 1 is known, it is possible to detect the surface layer thickness of the photosensitive drum 1 by tracking the change in reflectance as needed while utilizing the interference phenomenon. Incidentally, the layer thickness measuring device 11 can also have the function of measuring the amount of the toner deposited on the photosensitive drum 1.

Further, the layer thickness measurement is performed every 1,000 sheets at the time when the photosensitive drum 1 is at rest. At this time, in order to eliminate the measurement error, the layer thickness may also be measured at several points with respect to the circumferential direction of the photosensitive drum 1. Measured values of the layer thickness are stored in the memory and on the basis of the latest measurement result, the CPU 31 controls the magnetic particle supplying rate so as to be changed from 0.5 g per 1,000 sheets to 1.0 g per 1,000 sheets when the layer thickness change of not less than 15 per 10,000 sheets is caused to occur.

Thus, also in this embodiment, similarly as in First Embodiment, compared with the methods using the constant magnetic particle supplying rates, it was found that the image forming apparatus in this embodiment is totally advantageous in terms of both of that the photosensitive drum 1 lives out its lifetime and that the exchange timing of the magnetic particles is prolonged.

That is, according to Second Embodiment, it is possible to provide the image forming apparatus, including the charger employing the magnetic brush injection charging method, capable of permitting the image bearing member to live out the preliminarily estimated lifetime by controlling the surface layer abrasion amount (speed) of the image bearing member with less exchange frequency of the magnetic particles. Incidentally, in this embodiment, the supply timing of the magnetic particles is set at the time when image formation on the predetermined print number is performed on the sheet material but is not limited thereto. For example, the supply of the magnetic particles may also be performed at the time when the number of rotation of the photosensitive drum 1 or a rotation time of the photosensitive drum 1 exceeds a predetermined value.

Further, in First and Second Embodiments, the surface layer thickness measurement of the photosensitive drum 1 may preferably be effected when the photosensitive drum 1 is at rest. As a result, it becomes possible to enhance detection accuracy. When the measurement is effected during the rotation of the photosensitive drum 1, there is a possibility of a lowering in measurement accuracy due to vibration or eccentricity of the photosensitive drum 1.

Further, the layer thickness measuring device 11 may also include an openable shutter member 11*a* at a position at which the layer thickness measuring device 11 opposes the photosensitive drum 1. The shutter member 11*a* is configured to be opened at the time of the layer thickness detection of the photosensitive drum 1 and be closed at the time when the layer thickness detection of the photosensitive drum 1 is not performed. When the layer thickness measuring device 11 is contaminated, there is possibility of the lowering in detection accuracy. Therefore, as described above, the shutter member 11*a* is provided to realize an openable mechanism and is closed when the layer thickness measurement of the photosensitive drum 1 is not effected, so that it is possible to prevent contamination of the layer thickness measuring device 11.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 055214/2009 filed Mar. 9, 2009 and 026575/2010 filed Feb. 9, 2010, which are hereby incorporated by reference.

What is claimed is:

1. An image forming apparatus comprising:

an image bearing member for bearing an electrostatic latent image;

a charger for electrically charging said image bearing member by contact of electroconductive magnetic particles carried on a magnetic particle carrying member with said image bearing member;

a developing device for developing the electrostatic latent image into a toner image by supplying toner to the electrostatic latent image;

a layer thickness detecting device for detecting a thickness of a surface layer of said image bearing member;

a supplying device for supplying the magnetic particles to the magnetic particle carrying member with predetermined timing; and a control device for controlling a supply amount of the magnetic particles so that the supply amount of the magnetic particles supplied by said supplying device increases with an increase of an amount of change in thickness, in terms of an absolute value, of the surface layer obtained from a detection result of said layer thickness detecting device.

2. An apparatus according to claim 1, wherein said layer thickness detecting device detects the layer thickness of the surface layer by an eddy current method.

3. An apparatus according to claim 1, wherein said image bearing member includes a plurality of layers, and wherein said layer thickness detecting device detects the layer thickness of the surface layer by utilizing interference caused by reflection of light at each of a surface of said image bearing member and an interface between two layers, different in refractive index, of the plurality of layers.

4. An apparatus according to claim 1, wherein said layer thickness detecting device detects the layer thickness of the surface layer in a state in which said image bearing member is in rest.

5. An apparatus according to claim 1, wherein said layer thickness detecting device detects the layer thickness of the surface layer at a plurality of points with respect to a circumferential direction of said image bearing member.

6. An apparatus according to claim 1, wherein said layer thickness detecting device includes a shutter member openable at a position at which said layer thickness detecting device opposes said image bearing member, and wherein said shutter member opens when the layer thickness of the surface layer is detected and closes when the layer thickness of the surface layer is not detected.

* * * * *